US012487029B2

(12) United States Patent
Long et al.

(10) Patent No.: US 12,487,029 B2
(45) Date of Patent: Dec. 2, 2025

(54) METHOD OF REDUCING MERCURY IN STABILIZED CONDENSATE

(71) Applicant: CHEVRON U.S.A. INC., San Ramon, CA (US)

(72) Inventors: Christine Marie Long, El Cerrito, CA (US); Daniel Chinn, Danville, CA (US); Jinhua Bai, Katy, TX (US); Russell E. Cooper, Martinez, CA (US); Joshua A. Thompson, Martinez, CA (US)

(73) Assignee: CHEVRON U.S.A. INC., San Ramon, CA (US)

( * ) Notice: Subject to any disclaimer, the term of this patent is extended or adjusted under 35 U.S.C. 154(b) by 326 days.

(21) Appl. No.: 18/190,943

(22) Filed: Mar. 27, 2023

(65) Prior Publication Data

US 2024/0027129 A1 Jan. 25, 2024

Related U.S. Application Data

(63) Continuation of application No. 17/198,346, filed on Mar. 11, 2021, now abandoned.

(60) Provisional application No. 62/988,275, filed on Mar. 11, 2020.

(51) Int. Cl.
*F25J 3/02* (2006.01)
*C10G 7/00* (2006.01)

(52) U.S. Cl.
CPC ..... *F25J 3/0214* (2013.01); *C10G 7/00* (2013.01); *C10G 2300/1025* (2013.01); *C10G 2300/205* (2013.01); *F25J 2220/60* (2013.01); *F25J 2250/20* (2013.01)

(58) Field of Classification Search
CPC ..... F25J 3/0209; F25J 3/0214; F25J 3/0228; F25J 2250/20; F25J 2250/60; C10G 7/00; C10G 2300/1025; C10G 2300/205
See application file for complete search history.

(56) References Cited

U.S. PATENT DOCUMENTS 4,962,276 A * 10/1990 Yan ..... C10G 7/00 423/107
2015/0108040 A1* 4/2015 Lord, III ..... C10G 31/06 208/251 R
2017/0022431 A1* 1/2017 Guillou ..... C10G 53/08

* cited by examiner

*Primary Examiner* — In Suk C Bullock
*Assistant Examiner* — Jason Y Chong
(74) *Attorney, Agent, or Firm* — Jason M. Guerrero

(57) ABSTRACT

The present invention is directed to a method for removing elemental mercury from liquid natural gas comprising changing the stabilizer column operating conditions to beneficially transfer mercury from the stabilized condensate phase to the overhead gas phase, where it may be compressed and recycled with the gas going to the existing feed gas mercury removal units.

7 Claims, 11 Drawing Sheets

For 50% Gorgon/50% Jansz, < 50 ppb Hg is achievable at 200C bottoms temperature at 450 kPa. For 520 kPa, 207C needed.

For 50% Gorgon/50% Jansz, < 50 ppb Hg will result in ~1.3% less stabilized condensate production

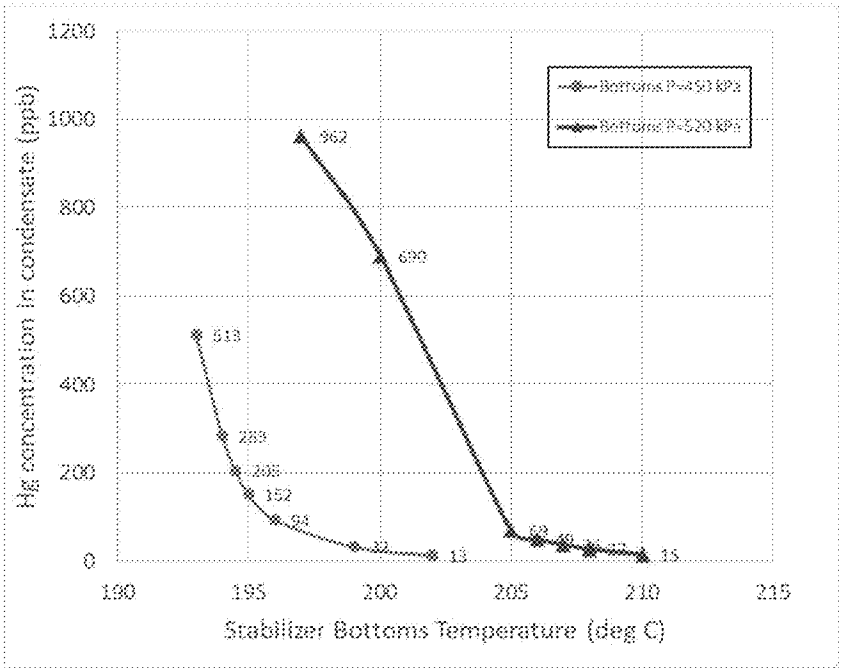
For 50% Gorgon/50% Jansz, < 50 ppb Hg is achievable at 200C bottoms temperature at 450 kPa. For 520 kPa, 207C needed.
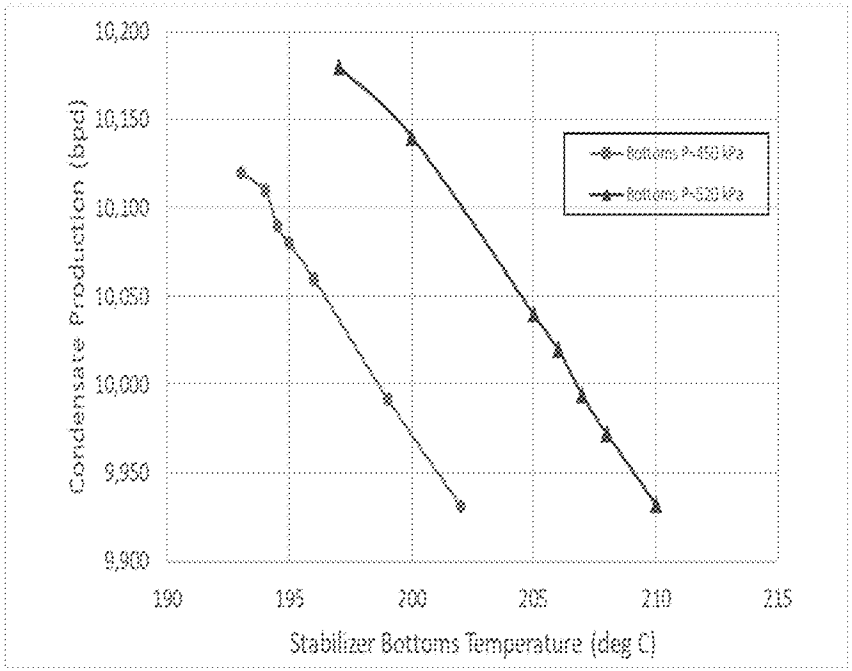
For 50% Gorgon/50% Jansz, < 50 ppb Hg will result in ~1.3% less stabilized condensate production
FIG. 1

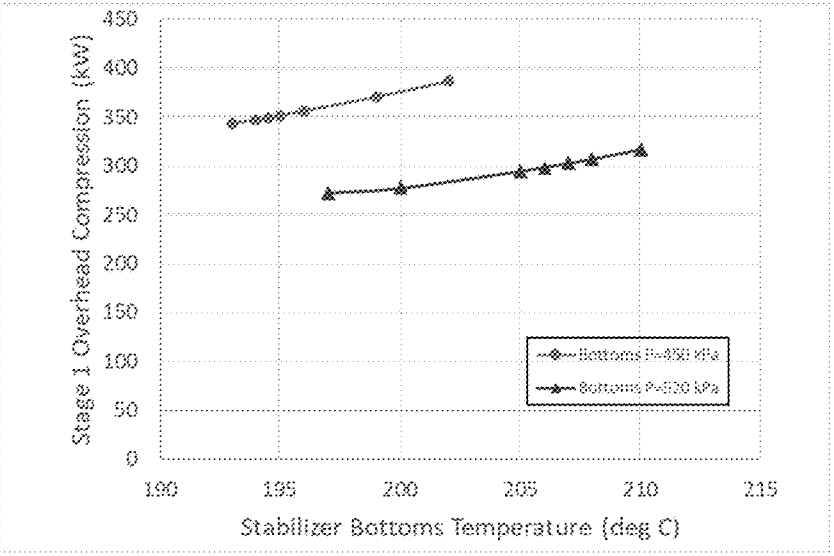
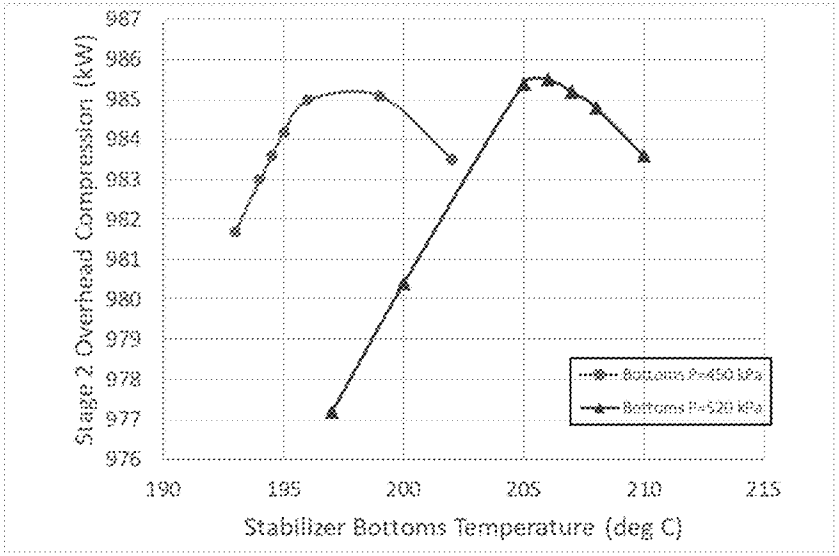
For 50% Gorgon/50% Jansz, a lower stabilizer pressure combined with higher reboiler temperature leads to higher Stage 1 compression hp.
FIG. 2

| | 70% Gorgon / 30%Jansz | 50% Gorgon/50% Jansz | 30% Gorgon/70% Jansz |
|---|---|---|---|
| Gas Flow to Gorgon MRU (MM Sm3/hr) | 2.74 | 1.98 | 1.22 |
| Gas Flow to Jansz (MM Sm3/hr) | 1.12 | 1.83 | 2.65 |
| Total Gas Flow: Gorgon+Jansz (MM Sm3/hr) | 3.86 | 3.81 | 3.87 |
| | | | |
| Condensate Production (bpd) | 11,690 | 10,120 | 8,595 |
| Condensate Hg (ppb) | 75 | 513 | 816 |
| | | | |
| Hg flow to Gorgon MRU (g/h) | 629 | 455 | 261 |
| Hg flow to Condensate (g/h) | 1.8 | 28 | 37 |
| Hg flow to Combined MEG (g/h) | 55 | 40 | 25 |
| Hg flow to Wet Gas Flare (g/h) | 46 | 0.9 | 0.23 |

*Stabilizer conditions of 450 kPa bottoms pressure and 193C bottoms temperature

FIG. 3

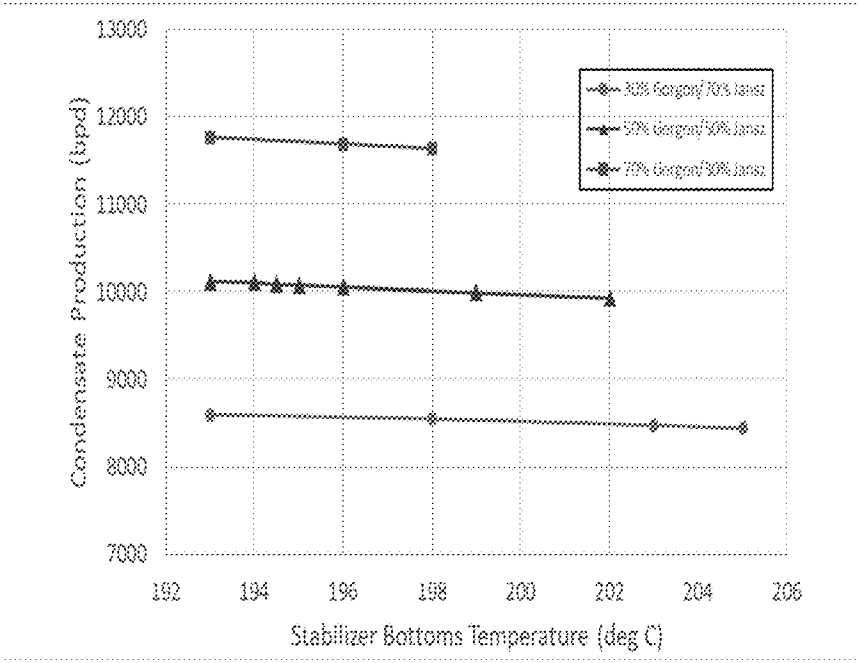
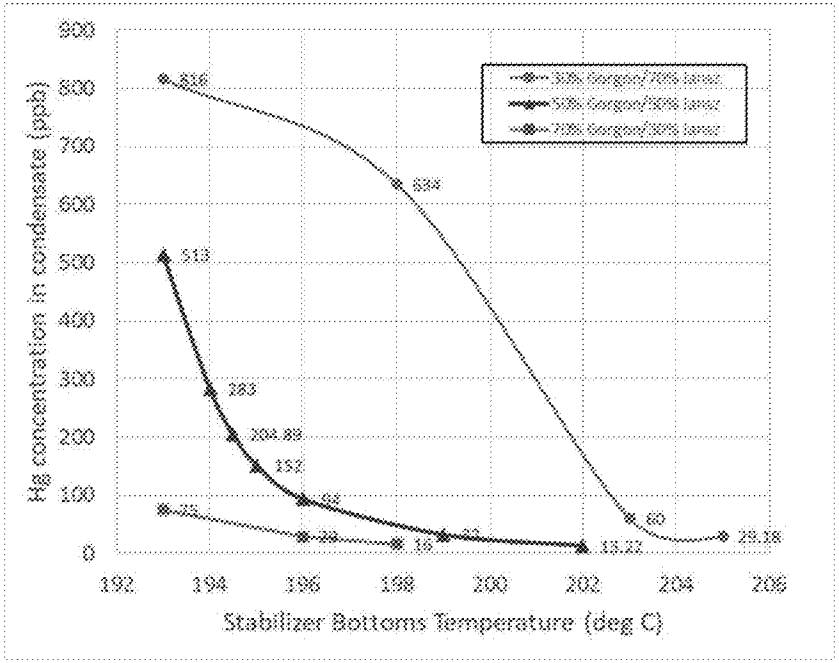
- With a higher ratio of Gorgon/Jansz, one produces more condensate, with much less dissolved Hg.
- The opposite is true for lower ratio of Gorgon/Jansz.
FIG. 4

- With a higher ratio of Gorgon/Jansz, the overhead stabilizer compression horsepower increases significantly
- The total Hg sent to the Gorgon Feed Gas MRU is also higher, as expected with higher Gorgon/Jansz ratio.

| Stage | Original Design Liquid | Original Design Vapor | Basecase Hysys Model Liquid | Basecase Hysys Model Vapor | Case 2 Liquid | Case 2 Vapor | Gorgon 70 Liquid | Gorgon 70 Vapor | Gorgon 30 Liquid | Gorgon 30 Vapor |
|---|---|---|---|---|---|---|---|---|---|---|
| 1___Main Tower | 100% | 100% | 42% | 0% | 45% | 0% | 53% | 0% | 37% | 0% |
| 2___Main Tower | 100% | 100% | 36% | 23% | 43% | 34% | 51% | 43% | 35% | 25% |
| 3___Main Tower | 100% | 100% | 41% | 20% | 51% | 36% | 60% | 44% | 42% | 29% |
| 4___Main Tower | 100% | 100% | 42% | 33% | 51% | 53% | 61% | 64% | 43% | 44% |
| 5___Main Tower | 100% | 100% | 42% | 35% | 51% | 55% | 60% | 66% | 42% | 45% |
| 6___Main Tower | 100% | 100% | 42% | 35% | 49% | 54% | 58% | 64% | 41% | 45% |
| 7___Main Tower | 100% | 100% | 42% | 36% | 48% | 52% | 56% | 62% | 40% | 43% |
| 8___Main Tower | 100% | 100% | 0% | 37% | 0% | 51% | 0% | 61% | 0% | 43% |
| Operating Pressure, kPag | 500 | | 500 | | 423 | | 423 | | 423 | |
| Rblr Out Temperature, C | 192.0 | | 197.0 | | 199.0 | | 196.0 | | 205.0 | |

- Vapor loads below design case can lead to excessive weeping on upper trays (poor tray efficiency)
- Lower-pressure operation increases volumetric vapor rates and helps reduce weeping
- 30% Gorgon/70% Jansz case will likely see excessive weeping in top trays
- 70% Gorgon/30% Jansz case looks barely OK at full model loads

FIG. 7

METHOD OF REDUCING MERCURY IN STABILIZED CONDENSATE

FIELD OF THE INVENTION

The field of the invention is the removal of elemental mercury from stabilized condensate in liquified natural gas processes.

BACKGROUND OF THE INVENTION

The well fluids from liquified natural gas processes are known to contain mercury in the stabilized condensate, which tends to partition between the gas, hydrocarbon and produced water phases upon arrival to the onshore inlet separators. Hydrocarbon condensate is sent to a stabilizer column to achieve a minimum Reid Vapor Pressure specification before being stored and eventually sold in cargoes. Due to vapor-liquid-equilibrium, there will always be mercury present in the stabilized condensate. Above a certain concentration, the condensate sells for a significant discount in the marketplace.

Conventional methods of treating the condensate is to install a mercury removal unit (MRU) to remove the mercury to levels below the discount concentration. MRUs are proven technologies for liquid phase mercury removal from condensate and refinery naphtha. The chemistry is based on irreversible complexation between elemental mercury and the copper sulfide groups on the adsorbent to form bound mercury sulfide. The primary disadvantages of the MRU are the need for new equipment and capital costs, operating costs for the disposal of spent adsorbent, operating costs for the makeup of fresh adsorbent and possible downtime and labor costs from the effort to physically replace spent adsorbent with fresh adsorbent.

SUMMARY OF THE INVENTION

A method for removing elemental mercury from liquid natural gas comprising changing the stabilizer column operating conditions to beneficially transfer mercury from the stabilized condensate phase to the overhead gas phase, where it may be compressed and recycled with the gas going to the existing Feed Gas MRUs.

BRIEF DESCRIPTION OF THE DRAWINGS

FIG. 1 is a comparative graph of the favorability of lower stabilizer pressure to remove mercury.

FIG. 2 is a comparative graph of the effect of lower stabilizer pressure on compression requirements.

FIG. 3 is a table of the impact of the Gorgon/Janz ratio on condensate production and mercury distribution.

FIG. 4 is a comparative graph of reboiler temperature at 450 kPa for variable Gorgon/Jansz.feeds, liquid side.

FIG. 7 is a table of the apparent loading of stabilizer trays in simulated conditions.

DETAILED DESCRIPTION OF THE INVENTION

Figure 5:
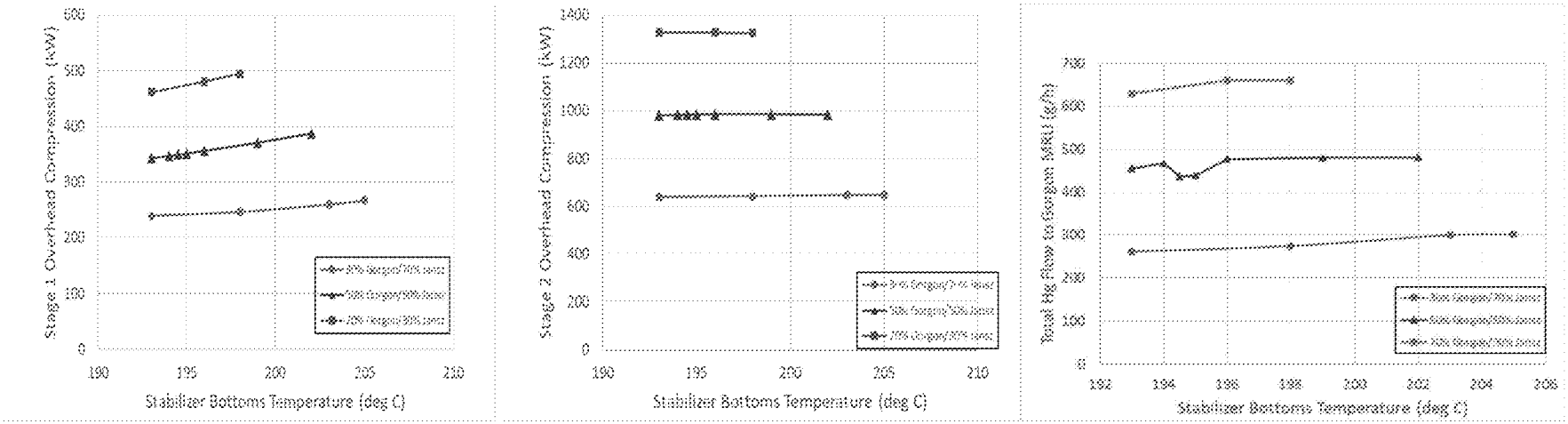
FIG. 5 is a comparative graph of reboiler temperature at 450 kPa for variable Gorgon/Jansz.feeds, gas side.
Figure 6:
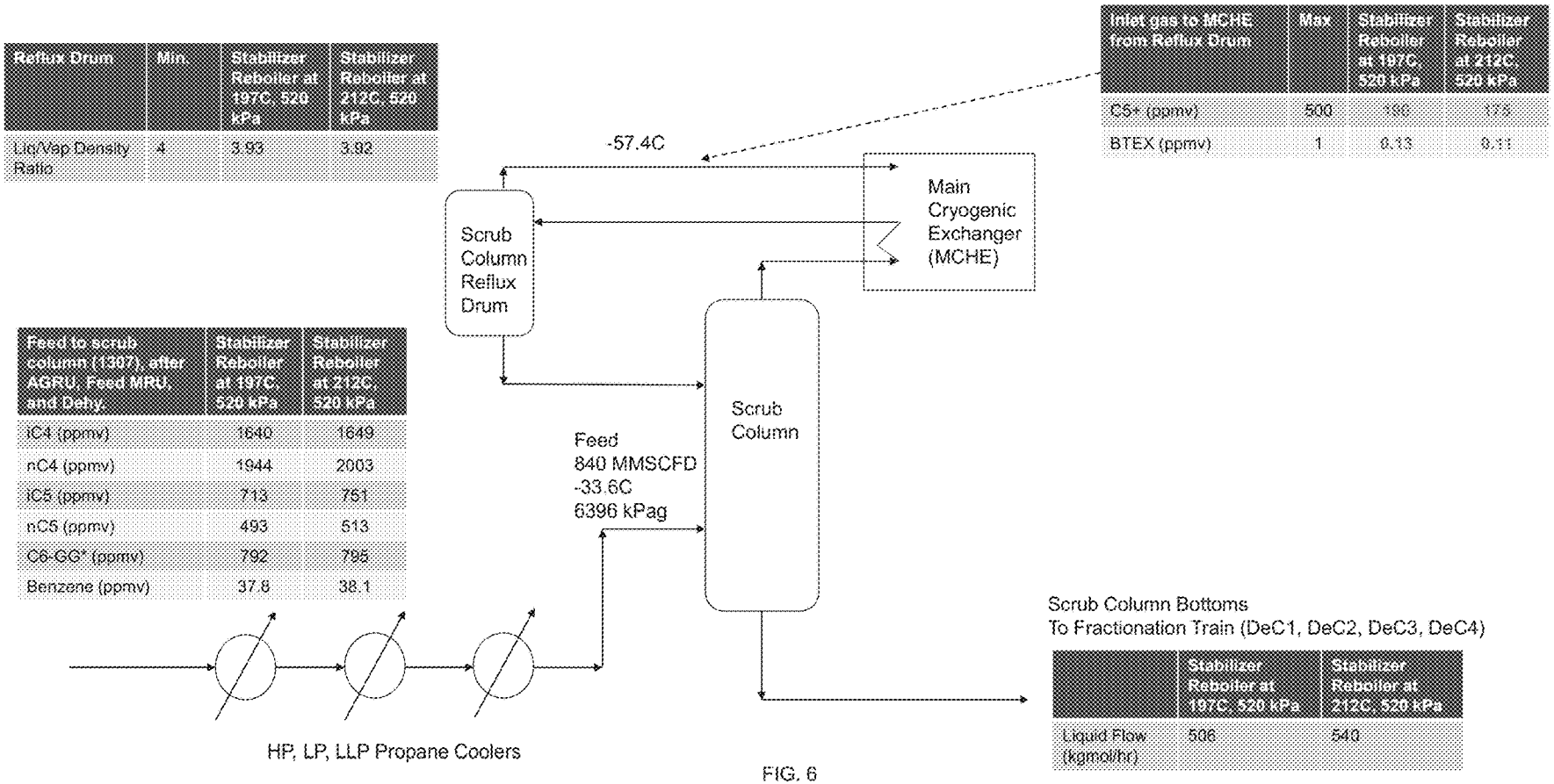
FIG. 6 is a schematic of the effect of higher boiler temperature on the movement of C4-C6 to the scrub column.
Figure 8:
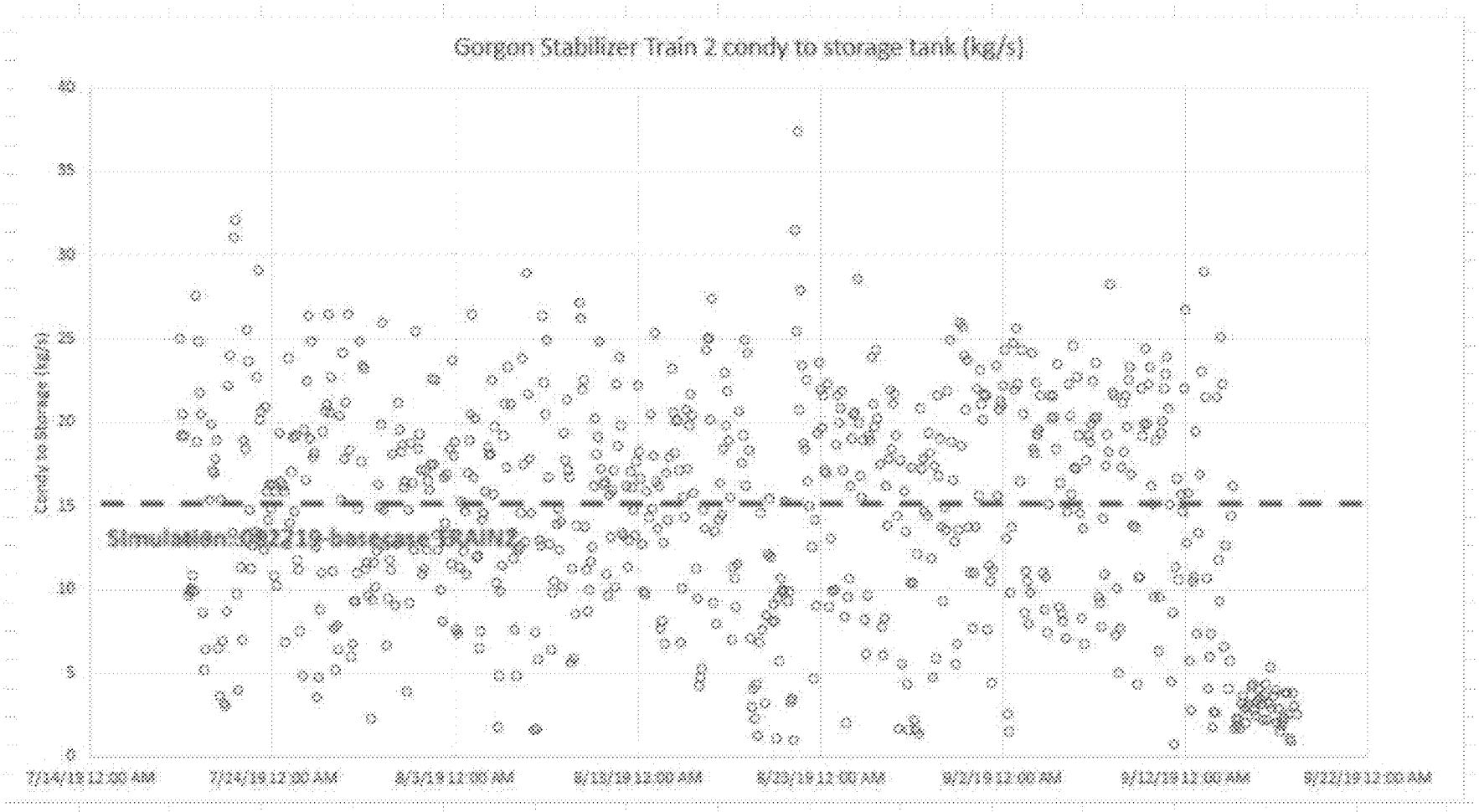
FIG. 8 is a plot of Gorgon stabilizer Train 2 condy to storage tank (kg/s).
Figure 9:
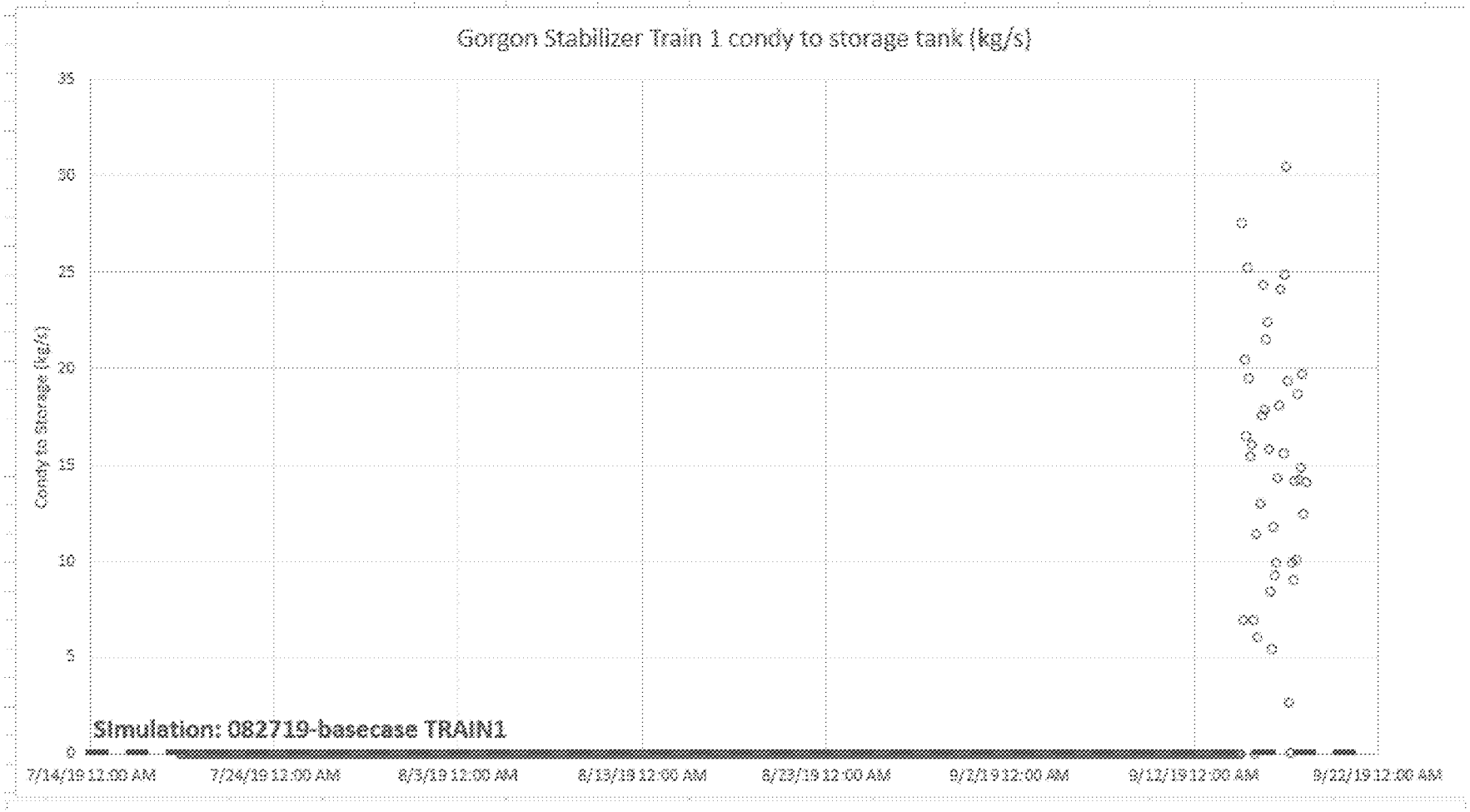
FIG. 9 is a plot of Gorgon stabilizer Train 1 condy to storage tank (kg/s).
Figure 10:
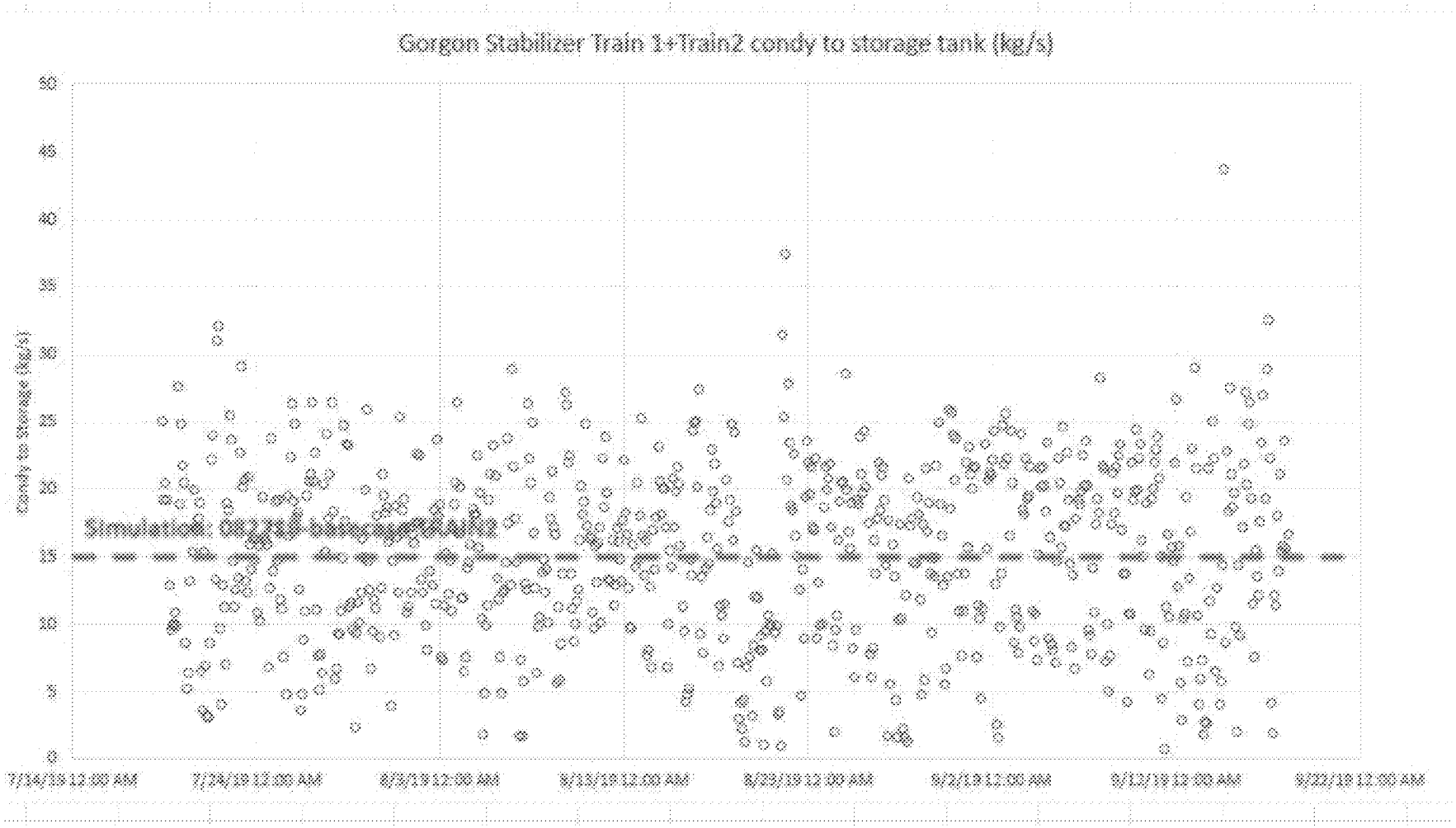
FIG. 10 is a plot of Gorgon stabilizer Train 1+Train 2 condy to storage tank (kg/s).
Figure 11:
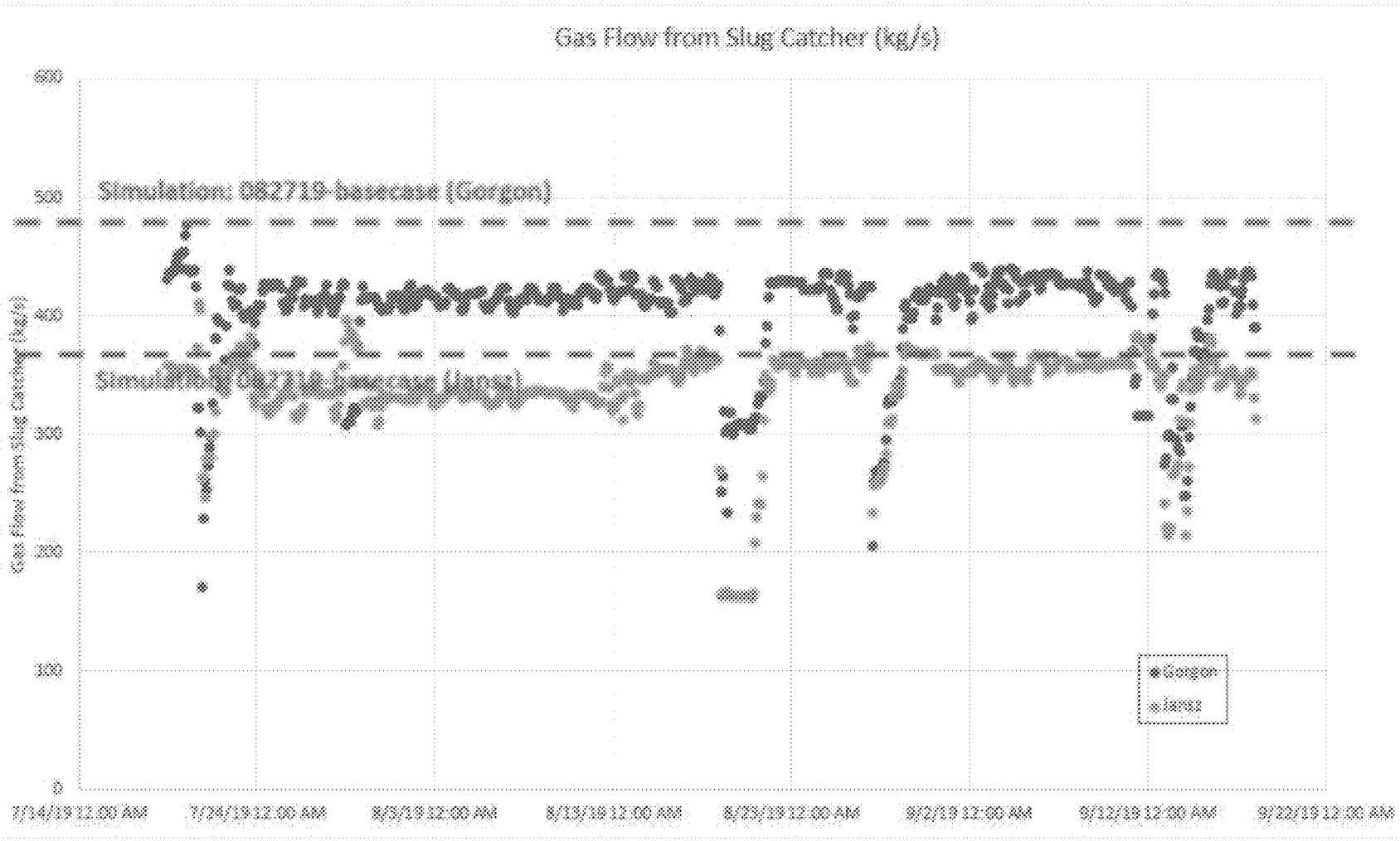
FIG. 11 is a plot of gas flow from slug catcher (kg/s).

This process invention is meant to cover a range of operating conditions of feed gases in a facility that produces natural gas and hydrocarbon liquids that contain elemental mercury. The ratio of mercury content from various feed wells determines the reboiler temperature.

While not being limited to the particular gas streams herein, representative liquid natural gas plants (LNG) are those containing two feed streams with differing mercury content, for example from 70% Gorgon/30% Jansz to 30% Gorgon/70% Jansz based on a CO2-free hydrocarbon-gas ratio feed to the gas processing portion of the LNG plant. As the mercury content is higher in Gorgon than in Jansz, the total hydrocarbon liquid and its mercury concentration going to the stabilizer can vary. Gorgon LNG also has two parallel trains of stabilizers, which are designed as 2×100%—this makes it possible to process 100% of the condensate in either stabilizer, 50% of the total condensate in each stabilizer, etc. Lastly, the Gorgon LNG plant is currently equipped with feed gas-phase MRUs on the inlet to each of the three parallel acid gas removal units (AGRU), along with product gas MRUs immediately upstream of each of the three LNG liquefaction units.

Gorgon LNG currently processes its entire condensate production through a single stabilizer (1×100%) operating at a bottoms pressure of 450 kpag and reboiler outlet temperature of 193 C. The stabilized condensate is estimated to have an average mercury content of 565 ppb at the average flowrate of 14.9 kg/s (~10,000 bpd). Total Gorgon condensate production can vary from as low as 0.77 kg/s (514 bpd) to 43.8 kg/s (29,383 bpd). An embodiment of the invention is a pressure of 500 kpag and 42 C. overhead and 520 kpag and 192 C. bottoms. An additional embodiment is the reboiler itself having a min/max design temperature of 7 C./250 C. for both the shell-side and tube side with design pressure of the reboiler is from full vacuum to 750 kpag on tube-side and 4600 kpag on the shell-side.

An embodiment of the invention is changing the stabilizer column operating conditions to beneficially transfer mercury from the stabilized condensate phase to the overhead gas phase, where it may be compressed and recycled with the gas going to the existing Feed Gas MRUs. The additional mercury added to the Feed Gas MRUs will result in a slight reduction in lifetime for the feed gas MRUs (e.g., 3.8 years life instead of 4 years life; 7.6 years life instead of 8 years life, etc.) and higher horsepower duty on the existing overhead gas compressors. There is also a slight increase in reboiler duty and related utility cost. However, the significant benefit is that no new capital equipment is required in order to treat the stabilized condensate below the discount level—at 20,000 bpd and $4/bbl this is $29 MM/year in benefits.

Another embodiment of the invention is the stabilizer bottoms operating pressure shall be at least 70 kpag below the design pressure (e.g., 450 kpag or less for design pressure of 520 kpag).

Another embodiment is the stabilizer column should be inspected, maintained, and controlled such that the reboiler outlet temperature and bottoms product temperature are within 1 deg C. or less during operation.

A further embodiment comprises two or more feeds that may comprise a mixture wherein the reboiler temperature is adjusted to the percent feed mixture. For example, Janz feed mixture and reboiler outlet temperature based on the Gorgon percentage:

for a 30% Gorgon/70% Jansz feed mixture, the reboiler outlet temperature is 204 C. or greater;

for a 50% Gorgon/50% Jansz feed mixture, the reboiler outlet temperature is 199 C. or greater;

for a 70% Gorgon/30% Jansz feed mixture, the reboiler outlet temperature is 196 C. or greater The higher reboiler outlet temperatures are achieved by increasing the flowrate of the heat transfer medium (i.e., currently pressurized hot water loop with supply temperature of 220 C.)

A preferred embodiment is in the event that that the target reboiler outlet temperature is not easily obtained with 1×100% stabilizer operation, then 2×50% stabilizer operation is utilized. Total mercury in the stabilized condensate is 50 ppb (by mass) or less.

Besides elimination of the mercury discount, the process invention has the following additional advantages:

1. Meeting or exceeding the required Reid Vapor Pressure (RVP) specification on the stabilized condensate 2. Despite higher amounts of C4 to C6 hydrocarbons sent to the overhead stream, no negative impact on the LNG scrub column operation.

What is claimed is:

1. A method for removing elemental mercury from a natural gas condensate feed comprising:

introducing the natural gas condensate feed into a stabilizer column;

operating the stabilizer column at conditions in which mercury is transferred from a stabilized condensate phase to an overhead gas phase;

compressing the overhead gas phase having the transferred mercury; and recycling the compressed overhead gas phase with the transferred mercury to one or more gas-phase mercury removal units located upstream of one or more liquefaction units.

2. The method of claim 1, comprising controlling operating conditions of the stabilizer column such that a reboiler outlet temperature of the stabilizer column and a bottoms product temperature are within 1° C. during operation.

3. The method of claim 2, wherein the natural gas condensate feed consists of a mixture of two or more streams of natural gas condensates.

4. The method of claim 3, wherein the reboiler outlet temperature of the stabilizer column is varied based on feed percentages of the two or more streams of natural gas condensates constituting the mixture.

5. The method of claim 4 wherein the feed mixture is 30% from a first source and 70% from a second source, and the reboiler outlet temperature is 204° C. or greater.

6. The method of claim 4, wherein the feed mixture is 50% from a first source and 50% from a second source, and the reboiler outlet temperature is 199° C. or greater.

7. The method of claim 4, wherein the feed mixture is 70% from a first source and 30% from a second source, and the reboiler outlet temperature is 196° C. or greater.

* * * * *